United States Patent [19]

Chakrabarti et al.

[11] 4,137,190

[45] Jan. 30, 1979

[54] DETERGENT COMPOSITION COMPRISING SYNERGISTIC HYDROTROPE MIXTURE OF TWO CLASSES OF ORGANIC PHOSPHATE ESTERS

[75] Inventors: Paritosh M. Chakrabarti, Wayne, N.J.; Richard A. Grifo, Bangor, Pa.

[73] Assignee: GAF Corporation, New York, N.Y.

[21] Appl. No.: 784,541

[22] Filed: Apr. 4, 1977

[51] Int. Cl.[2] ..... C11D 3/36; C11D 1/825; C11D 1/66

[52] U.S. Cl. ..... 252/135; 252/89 R; 252/DIG. 1; 252/DIG. 17

[58] Field of Search ..... 252/89 R, 135, DIG. 1, 252/DIG. 17

[56] References Cited

U.S. PATENT DOCUMENTS

| | | | |
|---|---|---|---|
| 3,004,056 | 10/1961 | Nunn et al. | 252/DIG. 1 X |
| 3,004,057 | 10/1961 | Nunn | 252/DIG. 1 X |
| 3,122,508 | 2/1964 | Grifo et al. | 252/DIG. 1 X |
| 3,235,627 | 2/1966 | Mansfield | 252/89 X |
| 3,294,693 | 12/1966 | Oupre et al. | 252/DIG. 17 X |
| 3,331,896 | 7/1967 | Eiseman et al. | 252/156 X |

OTHER PUBLICATIONS

Krupin, "Phosphate Ester Surfactants - Newer Uses," Soap & Chemical Specialties, May, 1969, pp. 86–92, 129, 130.

*Primary Examiner*—Harris A. Pitlick

*Attorney, Agent, or Firm*—W. C. Kehm; Arthur Dresner

[57] ABSTRACT

The invention relates to a detergent composition comprising a low-foaming, non-ionic surfactant and a synergistic hydrotrope mixture. The hydrotrope mixture is composed of two classes of organic phosphate esters A and B wherein A is the reaction product of a compound of the formula $$R + OCH_2CH_2 +_n OH$$

wherein R is alkyl, aryl, aralkyl, or alkaryl and n is 1 to 10, with phosphorus pentoxide and B is the reaction product of a compound of the above formula with polyphosphoric acid. The weight ratio of A:B is 1:9 to 9:1. The composition may further comprise an alkaline builder.

8 Claims, 2 Drawing Figures

DETERGENT COMPOSITION COMPRISING SYNERGISTIC HYDROTROPE MIXTURE OF TWO CLASSES OF ORGANIC PHOSPHATE ESTERS

Detergent compositions are often designed for specific cleaning jobs. Achieving a balance of the desired properties means careful attention must be paid to all the components of the detergent composition and their interaction with each other. It is often not easy to achieve the desired result without adversely effecting the desirable properties of one or more of the components.

Alkaline cleaners are the most widely used means in industry for cleaning metal, glass, certain plastics, etc. In the metal-forming field, in particular, such cleaners are used to remove various types of soils such as cutting oils, grinding, buffing, stamping and drawing compounds. The alkaline cleaning solutions may be used in various types of cleaning methods and apparatus, e.g., soaking, spraying, electrolytic, etc.

Currently, the trend in industrial use of industrial cleaners is in the direction of automated operations as a means of reducing manpower and time requirements. The preferred detergent products for these operations are aqueous built liquids containing surfactants and high levels of alkaline builders. The preferred surfactants are the non-ionic ethoxylated type, for they have some or all of the various desirable features such as superior detergent action, rapid wetting, low foaming capacity, emulsifying properties, free-rinsing, etc.

All non-ionic surfactants based on polyethylene oxide units as the hydrophylic portion, however, suffer from a basic deficiency. They have poor tolerance in solutions for alkaline electrolytes, and thus, are not soluble at the levels of alkaline builders required for a practical liquid detergent concentrate. This may be due to the fact that the ether oxygen atoms of the polyethyleneoxy chain lose water of hydration excessively in alkaline builder solutions. In any event, the non-ionic surfactants exhibit a cloud point. Above the temperature of the cloud point the surfactant separates into a second phase.

Alkaline builders cause the cloud point to be lowered to a point where phase separation occurs at ambient temperature. Increasing the number of ethoxy groups in the molecule does raise the cloud point in water or in builder solutions of low concentrations, but solubility at high builder concentrations still remains a problem.

A particularly difficult part of the general problem of incorporating non-ionic ethoxylated surfactants into aqueous alkaline builder concentrates is that of using low foaming non-ionic surfactants. This group of non-ionic surfactants must have relatively low cloud points in dilute solutions in order to exhibit low foaming properties at use temperatures. Consequently, they have not heretofore been capable of being efficiently incorporated into builder solutions. Nonetheless, low foaming non-ionics are especially desirable for incorporation into built liquid detergents since many of the automated cleaning machines employ a power washing cycle. Although their greater mechanical action enables power washers to give quicker and better cleaning action than is achieved by still-soaking and the like, their one big drawback is their tendency to generate excessive foam, the air content of which reduces the cleaner's density and mechanical impact. The use of low-foaming non-ionic surfactants not only avoids this problem, but also serves to reduce the foam caused by certain soils such as proteinaceous matter.

Hydrotropes are generally defined as organic compounds having hydrophobe hydrophile properties and being capable of increasing the solubility of other organic builders or salts in water or aqueous salt solutions. Since non-ionic surfactants have limited solubility in solutions of inorganic builders or salts, hydrotropes are essential in preparing built liquid detergents with non-ionic surfactants. In the absence of hydrotropes the built system will cause phase separation due to poor solubility of the non-ionic surfactants in these media. Typical known hydrotropes are alkali and ammonium salts of benzene, toluene, and xylene sulfonates commercially available, under proprietary names of Ultra KXS and SXS and Terpolate (registered trademark) ATS, KTS, STS, AXS, KXS and SXS, sodium alkylnapthalene sulfonate, commercially available, for example under the proprietary name Petro AA, etc. But these hydrotropes are capable of solubilizing conventional non-ionics in builder solutions of, at best, low solids content.

Conventional phosphate ester surfactants, made by reacting polyphosphoric acid with alkylphenol ethoxylates and having the structure $$\text{R-phenyl } O(CH_2CH_2O)_x\text{phosphate}$$

where R is H, or alkyl of 1 to 12 carbon atoms and x equals 1 to 20, have been suggested as hydrotropes (Column 2, Lines 56–67 U.S. Pat. No. 3,307,931 to Rohm & Haas of 3/7/67). The method for preparation of these phosphate esters has been disclosed in U.S. Pat. No. 3,235,627 to Rohm & Haas referred to in U.S. Pat. No. 3,307,931.

Phosphate esters made by reacting $P_2O_5$ with ethylene oxide condensate of organic hydroxy compounds can also act as hydrotropes depending upon the structure of the ethylene oxide condensate and the molar ratio of $P_2O_5$ used in the phosphation reaction.

Examples of commercial hydrotropes that are either $P_2O_5$ type phosphate esters or polyphosphoric acid type phosphate esters are Gafac$^R$ BH 650, Gafac$^R$ BI 750 and Gafac$^R$ RP-710 from GAF Corporation or Triton H-55, Triton H-66 or surfactant QS-44 from Rohm and Haas Co.

U.S. Pat. No. 3,579,453 to Rohm and Haas discloses substituted succinic acids, $$\begin{array}{l} R-CH-COOH, \\ \quad\;\; | \\ \quad\;\; CH_2-COOH \end{array}$$

where R is $C_7$ to $C_{12}$ carbon chain, as hydrotropes for non-ionic surfactants.

Individually these hydrotropes do not meet all the needs of the detergent industry. These hydrotropes, including the individual classes of the phosphate esters mentioned in the current invention, are known to have some solubilizing activity for non-ionics in builder solutions, but are unsatisfactory for most industrial applications because they require either too high a ratio of hydrotrope to non-ionic or permit only such a relatively low concentration of builder as to make the resulting products have too little economic utility.

It is, therefore, an object of the current invention to produce surfactant compositions that are soluble in solutions of alkaline builders having a high solids content.

Another objective is to provide means of solubilizing polyethylene oxide containing non-ionic surface active compositions into builder solutions.

Still another objective is to provide means of solubilizing polyethylene oxide containing low foaming non-ionic surface active compositions into builder solutions without substantially altering the low foaming character of the nonionic surface active compositions.

Still another objective of this invention is to provide a novel synergistic mixture of two classes of known phosphate esters as superior hydrotropes for non-ionic surfactants.

The present invention makes it possible to effectively incorporate non-ionic surfactants and, particularly, low-foaming type non-ionic surfactants, such as commercially available Antarox$^R$ BL's (from GAF) and Triton CF's (Rohm and Haas), into alkaline builder solutions. This is accomplished by mixing with those non-ionics, in certain ratios the hydrotropes of the current invention which consist of a blend of two classes of phosphate ester surfactants. The mixtures of (A), certain $P_2O_5$ derived phosphate esters with (B), certain polyphosphoric acid derived phosphate esters results in an outstandingly superior hydrotrope mixture. These two groups of phosphate esters behave synergistically in the blend, i.e., the hydrotropic capacity of the blends are significantly and unexpectedly superior to that of each ester alone.

Another advantage derived from the novel utilization of the complex phosphate ester hydrotropes of the current invention resides in the fact that they do not adversely affect the properties or performance characteristics of the non-ionics in the end-use baths. This particular characteristic is extremely important in power washing operations because any significant contribution of foam by the hydrotrope would make those materials useless.

The nonionic surfactants that can be solubilized according to the current invention contain a hydrophobic portion and a hydrophylic portion, the latter portion consisting principally or entirely of polyethylene oxide units and characterized by the fact that the molecule does not ionize in alkaline solutions. These consist of:

(A) $R(CH_2\text{-}CH_2O)_nR'$ where R is an alkoxy group whose alkyl portion has 8–30 carbon atoms, an alkyl amine whose alkyl portion has 8–30 carbon atoms, or an alkyl phenoxy group whose alkyl portion has 4 to 24 carbon atoms, where n = 1 to 90, and wherein R' is H, a $C_{1-4}$ alkyl group, benzyl, acetyl, acetal or $CH_2CH_2Cl$ group, or a polypropylene oxide chain, and (B) Ethylene oxide-propylene oxide block copolymers.

The low-foaming non-ionic surfactants mentioned in this invention are generally either of Type A where R' is other than H as defined or of Type B.

The effectiveness of the hydrotropes of the current invention in solubilizing polyethoxylated non-ionic surfactants can be readily demonstrated by comparing them with prior art solubilizers for non-ionics in alkaline builder solutions. In making such comparisons it should be kept in mind that the objective is to provide a solubilizing agent which will allow the highest concentrations of alkaline builders and which can be present at the minimum level for a given amount of non-ionic surfactant. Accomplishing this objective is paramount for practical economic considerations. Built liquid detergents with low builder levels, and consequently, high water contents have excessively high packaging, shipping and handling costs per part of active ingredient. Secondly, it is desirable to have present a minimum amount of any component that does not directly contribute to cleaning action; hence, the need to keep the amount of hydrotrope present down to the minimum possible consistent with its required solubilizing activity.

The weight ratio of non-ionic surfactant to hydrotrope mixture is generally 1:20 to 5:1 and preferably 1:10 to 2:1.

The various polyphosphoric acids which are available are generally regarded as being mixtures of orthophosphoric acid (corresponding to the formula $H_3PO_4$), pyrophosphoric acid ($H_4P_2O_7$), tripolyphosphoric acid ($H_5P_3O_{10}$), and the like "condensed" acids theoretically derived by condensation (involving water elimination and the formation of anhydride linkages) of two or more molecules of orthophosphoric acid. The composition of the above polyphosphoric acids is generally expressed by regarding said acids as mixtures of water ($H_2O$) and phosphorus pentoxide ($P_2O_5$) in varying proportions. The composition of any particular acid is generally stated in terms of percentage by weight of $P_2O_5$ therein; see, Van Wazer, Phosphorus and Its Compounds, vol. I, pages 747–9, Interscience, New York 1958. Thus, pure orthophosphoric acid corresponds theoretically to a mixture of $H_2O$ and $P_2O_5$ in the ratio of 3 moles of water to 1 mole of $P_2O_5$ and is expressed as phosphoric acid containing 72.4% $P_2O_5$. Similarly pyrophosphoric acid corresponds to a mixture of 2 moles of water to 1 mole of $P_2O_5$ and is expressed as phosphoric acid containing 79.5% $P_2O_5$.

An alternative method of designating the composition of polyphosphoric acids is in terms of their theoretical content of orthophosphoric acid. For example, phosphoric acid containing 72.4% $P_2O_5$ is referred to alternatively as 100% phosphoric acid meaning that its composition corresponds theoretically to pure orthophosphoric acid. Phosphoric acid analysing as 79.6% $P_2O_5$ is alternatively designated as 110% polyphosphoric acid; similarly 82.5% $P_2O_5$ acid is designated 114% polyphosphoric acid, 83.98% $P_2O_5$ is designated 116% polyphosphoric acid, and so on.

The polyphosphoric acids used in the present invention are generally 105–130% polyphosphoric acid and preferably 110–120% polyphosphoric acid.

The concentrated solutions of electrolytes and alkaline builders, which are particularly interesting for the purpose of the current invention, and, in which non-ionic surfactants can be very effectively solubilized by the hydrotropes of the current invention, are those generally found in built detergent systems. Examples of such electrolytes and builders are alkali metal hydroxides, alkali metal carbonates and bicarbonates, alkali metal phosphates including ortho, pyro, tripoly, other higher poly and various meta phosphates, alkali metal silicates, alkali metal sulfates, and alkali metal chlorides.

The weight ratio of the non-ionic surfactant to the electrolyte and builder is 1:5 to 1:100.

The hydrotrope compositions of the current invention comprises novel blends of two classes or organic phosphate ester surfactants derived from the ethylene oxide condensates of an organic hydroxy compound, the condensates being represented by the Formula I:

$$R(OCH_2\text{—}CH_2)_nOH \qquad (I)$$

wherein R is alkyl, aryl, aralkyl or alkaryl. If R is an alkyl group the number of carbon atoms is preferably 4 to 10. R may be phenyl or naphthyl. If R is alkaryl the alkyl portion preferably has 1 to 4 carbon atoms. The value of n is 1 to 10.

The Class A phosphate esters are derived by reacting the ethylene oxide condensates with phosphorus pentoxide in an anhydrous condition. The general procedures for the preparation of such phosphate esters have been descibed in U.S. Pat. Nos. 3,004,056 and 3,004,057 to GAF. These phosphate esters will be described by brief structural designations. Thus (3:1) $C_4H_9OE_1/P_2O_5$ would mean that it is a phosphate ester derived by reacting 1 mole (142 g) of anhydrous $P_2O_5$ with 3 moles (354 g) of the condensation product of one mole of butyl alcohol with one mole of ethylene oxide.

The Class B phosphate esters are derived by reacting the same ethylene oxide condensates with 105–130% polyphosphoric acid. Detailed procedures for preparation of such esters are described in U.S. Pat. No. 3,331,896 to GAF and in U.S. Pat. No. 3,235,627 to Rohm and Haas. For the purpose of brevity, the Class B phosphate esters of any particular ethylene oxide hydroxy compound will be described by the structure of the condensate followed by the abbreviation PPA and within parenthesis with a number which will designate the activity of the polyphosphoric acid used in preparing the particular phosphate ester. The structural designation will be preceeded with parenthesis, by a ratio of two numbers which will designate the molar ratio of the ethylene oxide condensate to the $P_2O_5$ equivalent of the polyphosphoric acid used in the said preparation. As an example, (1:1) $C_4H_9OE_1$/PPA (115%) would mean the phosphate ester derived by reacting 1 $P_2O_5$ mole equivalent of 115% polyphosphoric acid (i.e., 170 g of 115% polyphosphoric acid) with 1 mole (118 gms) of the condensation product of one mole of butyl alcohol with 1 mole of ethylene oxide. The method for making this particular phosphate ester is shown in Example XV of U.S. Pat. No. 3,331,896.

There are some basic differences in the stuctures of the phosphate esters derived by reacting the ethylene oxide condensate with polyphosphoric acid and those derived by reacting it with phosphorus pentoxide and such differences generally manifest themselves in a difference in their solubility, wetting power and other properties. U.S. Pat. No. 3,331,896 and 3,325,627 discuss such differences in some detail.

The molar ratio used in producing the Class A phosphate ester is generally 1:2 to 1:4.5 of phosphorus pentoxide to ethylene oxide condensate of Formula I. Preferably, the molar ratio is 1:2 to 1:4.

The molar ratio used in producing the Class B phosphate ester is generally 1:0.3 to 1:1.5 of polyphosphoric acid with a compound of Formula I. Preferably the molar ratio is 1:0.75 to 1:1.25.

The weight ratio of the hydrotrope blend, i.e. the ratio of Class A to Class B phosphate esters, expressed as A:B is generally 9:1 to 1:9 and preferably 1:4 to 4:1.

Figure 1:
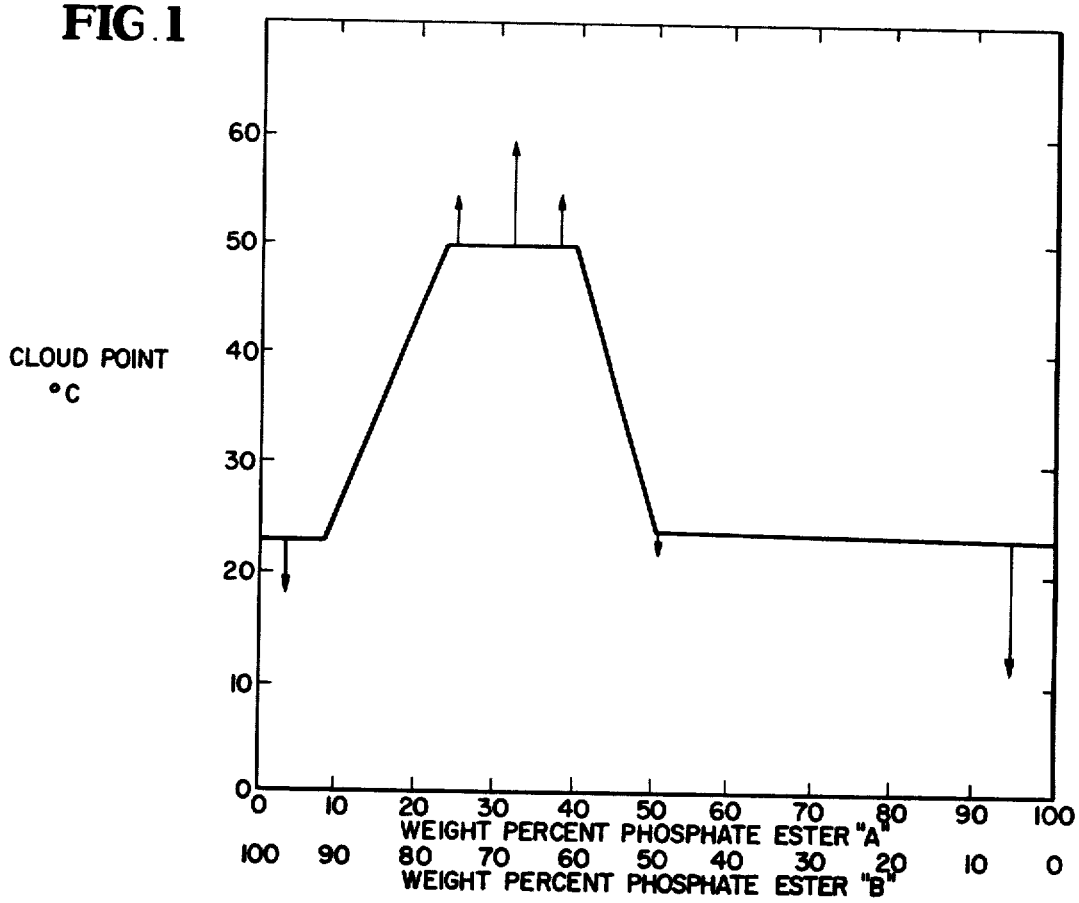
FIG. 1 is a graph of the cloud point versus the hydrotrope ratios used in Examples 2–13.

The present invention is illustrated by the following nonlimiting examples wherein all parts and percentages are by weight unless otherwise indicated.

EXAMPLE NUMBER 1

This example outline the general test procedure used in evaluating Examples 2 through 48 for hydrotropicity.

A one hundred gram formulation was made in each case in an 8 oz. jar as follows:

(1) The surfactant to be hydrotoped was mixed with the hydrotrope until clear or well dispersed.

(2) The desired amount of water was then added. The amount of water to be added was calculated by subtracting from one hundred the sum total of the grams of surfactant, hydrotrope and electrolyte and builder solution to be used.

(3) The electrolyte or mixture of electrolyte and builder was then added and the mixture agitated for 15 minutes at room temperature.

(4) In case the resultant solution was clear at room temperature, it was gently warmed until cloudiness was developed. This temperature was recorded as the cloud point. The higher the cloud point, the higher was considered to be the effectiveness of the hydrotrope. Cloud points of about 50° C. or above were not measured since anything equal to or above 50° C. was considered to be highly satisfactory.

EXAMPLE NUMBERS 2–13

These examples show the efficiency of a blend of the $P_2O_5$ derived ester of a six moles ethylene oxide adduct of phenol and the 115% polyphosphoric acid derived ester of a four mole ethylene oxide adduct of isoamyl alcohol in solubilizing a chlorine capped low foaming surfactant trade named (GAF) Antarox$^R$ BL 330 in a solution of electrolyte consisting of a mixture of tetrapotassium pyrophosphate and potassium hydroxide.

Formulations were made according to Example 1 from the following components:

| | | |
|---|---|---|
| Antarox$^R$ BL 330 | 1 | part |
| Tetrapotassium Pyrophosphate ($K_4P_2O_7$) | 24 | parts |
| Potassium Hydroxide (KOH) | 16 | parts |
| Water | 55 | parts |
| Hydrotrope | 4 | parts |
| TOTAL | 100 | parts |

The different formulations differed in the hydrotrope used which was either (a) (2.7:1)$C_6H_5OE_6/P_2O_5$, i.e., a phosphate ester derived by reacting 2.7 moles of a condensation product of six moles of ethylene oxide with 1 mole of phenol with 1 mole of phosphorus pentoxide, or (b) (1:1) iso $C_5H_{11}OE_4$/PPA (115%), i.e., a phosphate ester derived by reacting one $P_2O_5$-mole-equivalent of 115% polyphosphoric acid with 1 mole of the condensation product of four moles ethylene oxide and 1 mole iso amyl alcohol or (c) a blend of "a" and "b". The cloud points of the formulations indicate efficacies of the hydrotropes used. Results are shown in Table 1.

TABLE 1

| EXAMPLE NUMBER | HYDROTROPE COMPOSITION: PARTS BY WEIGHT IN TOTAL 4 PARTS (2.7:1) $C_6H_5OE_6/P_2O_5$ A | (1:1) ISO $C_5H_{11}OE_4$/PPA (115%) B | BLEND RATIO A/B | APPEARANCE OF FORMULATION AT 23° C | CLOUD POINT OF FORMULATION |
|---|---|---|---|---|---|
| 2 | 0.0 | 4.0 | 0/100 | Cloudy | <23° C |
| 3 | 0.4 | 3.6 | 10/90 | Cloudy | <23° C |
| 4 | 1.0 | 3.0 | 25/75 | Clear | >50° C |
| 5 | 1.2 | 2.8 | 30/70 | Clear | >50° C |
| 6 | 1.4 | 2.6 | 35/65 | Clear | >50° C |
| 7 | 1.6 | 2.4 | 40/60 | Clear | >50° C |
| 8 | 1.8 | 2.2 | 45/55 | Clear | 38° C |
| 9 | 2.0 | 2.0 | 50/50 | Cloudy | 23° C |
| 10 | 2.2 | 1.8 | 55/45 | Cloudy | <23° C |
| 11 | 2.4 | 1.6 | 60/40 | Cloudy | <23° C |
| 12 | 3.0 | 1.0 | 75/25 | Cloudy | <23° C |
| 13 | 4.0 | 0.0 | 100/0 | Cloudy | <23° C |

It may be seen from Table 1 that blends of A and B act synergistically being far superior to either A or B alone as hydrotropes. In the particular examples shown above, the most optimum ratio between the phosphate ester "A" and phosphate ester "B" is between 25/75 to 40/60. These results are graphically represented in FIG. 1, where the upward arrows indicate cloud points higher than those shown by the solid line and the downward arrows indicate the reverse.

EXAMPLE NUMBERS 14–21

These examples are similar to those of Example 2–13 except that the hydrotrope used was derived from (a) (2.7:1) $C_6H_5OE_6/P_2O_5$ and (b) (1:1) $C_4H_9OE_1$/PPA (115%), i.e., phosphate ester derived by reacting one $P_2O_5$-mole-equivalent of 115% polyphosphoric acid with 1 mole of a condensation product of 1 mole ethylene oxide and one mole n-butanol. The general test formulation used was the same as that in Example 2–13, i.e.,

| | | |
|---|---|---|
| Antarox$^R$ BL 330 | 1 | part |
| $K_2P_4O_7$ | 24 | parts |
| KOH | 16 | parts |
| $H_2O$ | 55 | parts |
| Hydrotrope | 4 | parts |
| TOTAL | 100 | parts |

Figure 2:
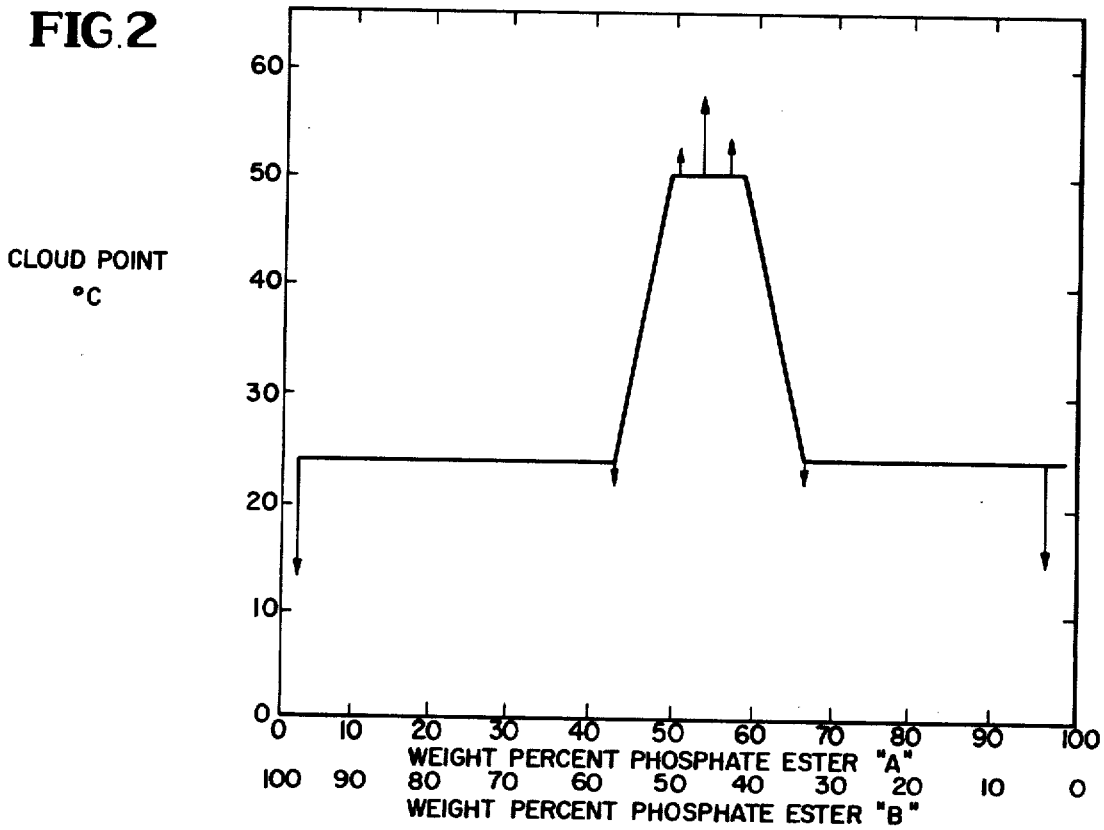
FIG. 2 is a graph of the cloud point versus the hydrotrope ratio used in Examples 14–21.

The results are shown in Table II and FIG. 2. These results show that the optimum ratio between (2.7:1) $C_6H_5OE_6/P_2O_5$ phosphate ester and (1:1) $C_4H_9OE_1$/PPA (115%) phosphate ester is between 50/50 to 60/40 in the particular nonionic-electrolyte systems shown.

TABLE II

| EXAMPLE NUMBER | HYDROTROPE COMPOSITION: PARTS BY WEIGHT IN TOTAL 4 PARTS (2.7:1) $C_6H_5OE_6/P_2O_5$ A | (1:1) $C_4H_9OE_1$/PPA (115%) B | BLEND RATIO A/B | APPEARANCE OF FORMULATION AT 23° C | CLOUD POINT OF FORMULATION |
|---|---|---|---|---|---|
| 14 | 0.0 | 4.0 | 0/100 | Cloudy | <23° C |
| 15 | 1.0 | 3.0 | 25/75 | Cloudy | <23° C |
| 16 | 1.8 | 2.2 | 45/55 | Cloudy | <23° C |
| 17 | 2.0 | 2.0 | 50/50 | Clear | >50° C |
| 18 | 2.2 | 1.8 | 55/45 | Clear | >50° C |
| 19 | 2.4 | 1.6 | 60/40 | Clear | 47° C |
| 20 | 3.0 | 1.0 | 75/25 | Cloudy | <23° C |
| 21 | 4.0 | 0.0 | 100/0 | Cloudy | <23° C |

EXAMPLE NUMBERS 22–27

In these examples the hydrotrope used is a 40/60 blend of the following phosphate esters: (2.7:1)$C_6H_5OE_6/P_2O_5$ and (1:1) iso $C_5H_{11}OE_4$/PPA (115%). This blend ratio was chosen as the blend of choice between these two phosphate esters in view of Example 2–13.

The amount of the hydrotrope in Example 22–27 was varied to determine the minimum amount required to yield desirable performances. The formulation used for testing was essentially the same as that used in the earlier examples (2 to 21) except for the amount of hydrotrope (a variable) and water. The formulation was as follows and was made according to Example 1:

| | |
|---|---|
| Antarox$^R$ BL 330 | 1 part |
| $K_2P_4O_7$ | 24 parts |
| KOH | 16 parts |
| Hydrotrope | 1 to 6 parts |
| Water | Q.S. to 100 parts |
| TOTAL | 100 parts |

The results of these examples are shown in Table III.

TABLE III

| EXAMPLE # | PARTS HYDROTROPE* IN FORMULATION | CLOUD POINT |
|---|---|---|
| 22 | 1.0 | <23° C |
| 23 | 2.0 | >50° C |
| 24 | 3.0 | >50° C |
| 25 | 4.0 | >50° C |
| 26 | 5.0 | >50° C |
| 27 | 6.0 | >50° C |

*a 40/60 blend of a) (2.7:1)$C_6H_5OE_6/P_2O_5$ and b) iso $C_5H_{11}OE_4$/PPA (115%)

As can be seen from the above examples, a proper blend of (a) (2.7:1) $C_6H_5OE_6/P_2O_5$ and (b) iso $C_5H_{11}OE_4$/PPA (115%) is a highly efficient hydrotrope being outstanding in the formulation tested at as low as 2% concentration.

EXAMPLE NUMBERS 28-33

These examples are similar to Example 22-27 except that the hydrotrope used is a 55/45 blend of: (2.7:1)$C_6H_5OE_6/P_2O_5$ and (1:1) $C_4H_9OE_1$/PPA (115%). The blend ratio being selected as a ratio of choice from Examples 14-21. The formulation used for testing was similar to that in Examples 22-27, namely:

| | |
|---|---|
| Antarox[R] BL 330 | 1 part |
| $K_4P_2O_7$ | 24 parts |
| KOH | 16 parts |
| Hydrotrope | 1 to 6 parts |
| Water | Q.S. to 100 parts |
| TOTAL | 100 parts |

The results are shown in Table IV.

TABLE IV

| EXAMPLE NUMBER | PARTS HYDROTROPE* IN FORMULATION | CLOUD POINT |
|---|---|---|
| 28 | 1.0 | <23° C |
| 29 | 2.0 | >50° C |
| 30 | 3.0 | >50° C |
| 31 | 4.0 | >50° C |
| 32 | 5.0 | >50° C |
| 33 | 6.0 | >50° C |

*a 55/45 blend of a) (2.7:1)$C_6H_5OE_6/P_2O_5$and b) iso $C_5H_{11}OE_4$/PPA (115%)

It can, again, be seen from these examples that at proper ratios a $P_2O_5$ type phosphate ester of the current invention and a polyphosphoric acid phosphate ester of the current invention is a very efficient hydrotrope being effective at a very low concentration.

EXAMPLE NUMBERS 34-39

These examples demonstrate that the phosphate ester blend of the current invention can contain more than two individual phosphate esters as long as they belong to two distinct groups; namely, $P_2O_5$ derived group and a polyphosphoric acid derived group and satisfy the other structural parameters described before.

These examples are similar to those Example 2 to 13 and 14 to 21 except that the hydrotrope is a blend of the individual phosphate esters; namely, (1) (2.7:1) $C_6H_5OE_6/P_2O_5$, (2) (1:1) iso $C_5H_{11}OE_4$/PPA (115%) and (3) (1:1) $C_4H_9OE_1$/PPA (115%), the first one belonging to a $P_2O_5$ type ester and the second and the third to a polyphosphoric acid type ester. The formulation used for testing was similar to that used in the previous examples — contained 4% total hydrotrope and was made in accordance to the procedure laid down in Example 1.

| | |
|---|---|
| Antarox[R] BL 330 | 1 part |
| $K_4P_2O_7$ | 24 parts |
| KOH | 16 parts |
| Water | 55 parts |
| Hydrotrope | 4 parts |
| TOTAL | 100 parts |

The affects of the variation of the hydrotrope composition on the cloud points of the formulation are shown in Table V.

TABLE V

| EX. NO. | PHOSPHATE ESTER HYDROTROPE COMPOSITION: $P_2O_5$- Derived (A) (2.7:1) $C_6H_5OE_6/P_2O_5$ | POLYPHOSPHORIC ACID DERIVED (B): (1:1) iso $C_5H_{11}OE_4$/PPA (115%) | (1:1)$C_4H_9OE_1$/PPA (115%) | RATIO A:B | CLOUD POINT OF FORMULATION |
|---|---|---|---|---|---|
| 34 | 20% | 40% | 40% | 20/80 | <23° C |
| 35 | 30% | 35% | 35% | 30/70 | <23° C |
| 36 | 40% | 30% | 30% | 40/60 | >50° C |
| 37 | 50% | 25% | 25% | 50/50 | >50° C |
| 38 | 50% | 20% | 20% | 60/40 | <23° C |
| 39 | 70% | 15% | 15% | 70/30 | <23° C |

EXAMPLE NUMBERS 40-44

In the previous examples, i.e., in Examples 2 to 39, only one low foaming nonionic; namely, a chlorine capped nonionic, tradenamed (GAF) Antarox BL 330, was used to demonstrate the efficacy of the hydrotrope compositions of the current invention. Examples 40 and 41 show that the hydrotrope compositions of the current invention are also applicable to other types of low foaming surfactants. Examples 42-44 show that the compositions of the current invention are superior hydrotropes to other commercial phosphate ester hydrotropes such as Triton H-66 from Rohm and Haas Co.

The low-foaming surfactants used in Examples 40-44 are Triton CF 10 and Triton CF 54 from Rohm and Haas Co. and belong to an alkyl (or arylalkyl) terminated nonionic class.

The formulation used in Examples 40-44 was as follows:

| | |
|---|---|
| Low Foaming Surfactant | 1 part |
| $K_4P_2O_7$ | 18 parts |
| KOH | 12 parts |
| Hydrotrope (active) | 2 to 5 parts |
| Water | Q.S. to 100 |
| TOTAL | 100 parts |

The formulations were made and their cloud points were determined according to the procedures described in Example 1. The results are shown in Table VI.

TABLE VI

| EXAMPLE NUMBER | HYDROTROPE IN FORMULATION: NAME | % AS-IS | % ACTIVE | FORMULATION CLOUD POINT USING LOW FOAMING SURFACTANT: TRITON CF 10 | TRITON CF 54 |
|---|---|---|---|---|---|
| 40 | Hydrotrope of Example 7[1] | 4 | 4 | 40 ° C | 40° C |
| 41 | Hydrotrope of Example 18[2] | 4 | 4 | >50° C | >50° C |
| 42 | Triton H-66[3] | 8 | 4 | <23° C | <23° C |
| 43 | Triton H-66[3] | 12 | 6 | — | <23° C |

TABLE VI-continued

| EXAMPLE NUMBER | HYDROTROPE IN FORMULATION | | | FORMULATION CLOUD POINT USING LOW FOAMING SURFACTANT | |
|---|---|---|---|---|---|
| | NAME | % AS-IS | % ACTIVE | TRITON CF 10 | TRITON CF 54 |
| 44 | Triton H-66[3] | 16 | 8 | — | <23° C |

[1]This is a 40/60 blend of (2.7:1) $C_6H_5OE_6/P_2O_5$ and (1:1) iso $C_5H_{11}OE_4$/PPA (115%)
[2]This is a 55/45 blend of (2.7:1) $C_6H_5OE_6/P_2O_5$ and (1:1) $C_4H_9OE_1$/PPA (115%)
[3]Triton H-66 as-is is only 50% active

EXAMPLE NUMBERS 45–48

The previous examples were limited to:

(a) One electrolyte system; namely, a mixture of potassium pyrophosphate and potassium hydroxide and (b) Two types of low foaming nonionics, namely, a chlorine capped type represented by Antarox$^R$ BL 330 (GAF) and an alkyl (or arylalkyl) ether capped type represented by Triton CF 10 (Rohm & Haas) and Triton CF 54 (Rohm & Haas).

Examples 45–48 are designed to show that the superior performance of the hydrotropes of the current invention are not limited to one electrolyte system. They are also designed to show that other types of low foaming nonionics, such as polypropylene oxide terminated low foaming nonionics can be solubilized by compositions of the current invention.

The electrolyte used in Examples 45–48 is a mixture of sodium and potassium salts; namely, $Na_2SiO_3$ and $K_4P_2O_7$. The low foaming surfactant used is Antarox$^R$ BL-225 (GAF) which is a polypropyleneoxy terminated nonionic surfactant.

The hydrotropes used are the individual phosphate ester types, viz the $P_2O_5$ derived and the polyphosphoric acid derived types and a blend of the two. A competitive hydrotrope; namely, Triton H-66, is also used for comparison.

The formulation used for determination of cloud point was as follows and was made according to the procedure described in Example 1.

| | |
|---|---|
| Antarox$^R$ BL-225 | 2 parts |
| $K_4P_2O_7$ | 20 parts |
| $Na_2SiO_3$ | 5 parts |
| Hydrotrope (as 100% active) | 5 parts |
| Water | Q.S. to 100 |
| TOTAL | 100 parts |

The results are shown in Table VII below.

TABLE VII

| EXAMPLE NUMBER | HYDROTROPE | CLOUD POINT OF FORMULATION |
|---|---|---|
| 45 | Hydrotrope of Example 13[1] | 35° C |
| 46 | Hydrotrope of Example 2[2] | 24° C |
| 47 | Hydrotrope of Example 11[3] | 45° C |
| 48 | Triton H-66[4] | 25° C |

[1]This is (2.7:1) $C_6H_5OE_6/P_2O_5$
[2]This is (1:1) iso $C_5H_{11}OE_4$/PPA (115%)
[3]This is a 60/40 blend of "1" and "2"
[4]Commercial phosphate ester hydrotrope from Rohm & Haas It may be seen from Table VII that Example 47 which uses the hydrotrope of the current invention has outstandingly higher cloud point than others.

EXAMPLE NUMBERS 49–61

These examples will illustrate the wider scope of the invention in so far as its claimed limits are concerned, namely that (a) The hydrophobic moiety in the phosphate esters could be $C_4$ to $C_{10}$ (b) The hydrophobe in both the $P_2O_5$ derived and the polyphosphoric acid derived phosphate esters could be alkyl or aryl or it could be alkyl in one case and aryl in the other and that (c) The number of ethyleneoxide units per mole of the phosphate ester precursors (i.e., in the ethylene oxide adduct of hydroxy compounds from which the phosphate esters are made) could be 1 to 10.

Examples 49–61 will demonstrate that synergism exists between a $P_2O_5$-derived and a polyphosphoric acid derived phosphate ester within the above disclosed parameters in so far as hydrotropicity for nonionic surfactants is concerned. The test procedure used for determining hydrotrope efficacy in Examples 49–61 is somewhat different than that described in Example 1. The procedure used in these examples was as follows.

The following components were measured into an 8 oz. jar to give 100 g formulation.

| | | |
|---|---|---|
| The hydrotrope composition | 4 | g |
| Water | 55 | g |
| Potassium hydroxide | 16 | g |
| Tetrapotassium pyrophosphate | 24 | g |
| Nonionic Surfactant (to be hydrotroped) | 1 | g |
| TOTAL | 100 | g |

The above mixture was vigorously shaken until homogeneous. It was then allowed to stand for 1 minute and its appearance was noted. If it looked cloudy, the formulation (100 g) was titrated with 5 g increments of distilled water. After each 5 g addition of water the mixture was well shaken and observed for clarity. The addition of water was continued until the mixture turned into a clear solution. The total weight of distilled water needed for clarity was noted. The higher the amount of water required for clarity, the lower was the efficacy of the hydrotrope used in the system.

The results of the test are shown in the following table (Table VIII). In each example as mentioned above 4 g hydrotrope was used. Each example was broken down into three subexamples — a, b & c. Subexample "a" used a $P_2O_5$ derived phosphate ester, subexample "b" used a polyphosphoric acid derived phosphate ester and subexample "c" used a 50/50 blend of the $P_2O_5$ derived and the polyphosphoric acid derived ester. When the amount of water required to obtain clarity in subexample "c" was lower than that required either in subexample "a" or in subexample "b", it indicated that the blend exhibited synergistic effect.

As can be seen from the following examples, the blends in each case exhibited synergism over the individual phosphate esters.

TABLE VIII

| EXAMPLE NUMBER | | HYDROTROPE USED | NONIONIC SURFACTANT (LOW FOAMING) | TITER (G DISTILLED WATER TO CLARITY |
|---|---|---|---|---|
| 49 | a | (2.7:1) $C_6H_5OE_6/P_2O_5$ | Antarox$^R$ BL 240 | >50 |
| | b | (1:1) $C_6H_5OE_6$/PPA (115%) | Same | >50 |
| | c | 50/50 blend of 49a and 49b | Same | 15 |
| 50 | a | Same as 49a | Antarox$^R$ BL 330 | 50 |
| | b | Same as 49b | Same | >130 |
| | c | Same as 49c | Same | 5 |
| 51 | a | Same as 49a | Antarox$^R$ BL 334 | >100 |
| | b | Same as 49b | Same | 100 |
| | c | Same as 49c | Same | 10 |
| 52 | a | Same as 49a | Antarox$^R$ BL 240 | 50 |
| | b | (1:1) $C_4H_9OE_1$/PPA (115%) | Same | 100 |
| | c | 50/50 blend of 52a and 52b | Same | 0 |
| 53 | a | Same as 52a | Antarox$^R$ BL 330 | 55 |
| | b | Same as 52b | Same | >130 |
| | c | Same as 52c | Same | 0 |
| 54 | a | Same as 52a | Antarox$^R$ BL 344 | 45 |
| | b | Same as 52b | Same | >100 |
| | c | Same as 52c | Same | 0 |
| 55 | a | Same as 49a | Antarox$^R$ BL 330 | 55 |
| | b | (1:1) iso $C_{10}H_{21}OE_4$/PPA (115%) | Same | 55 |
| | c | 50/50 blend of 55a and 55b | Same | 20 |
| 56 | a | Same as 55a | Antarox$^R$ BL 225 | 50 |
| | b | Same as 55b | Same | 70 |
| | c | Same as 55c | Same | 20 |
| 57 | a | Same as 49a | Antarox$^R$ BL 330 | 55 |
| | b | (1:1) iso $C_{10}H_{21}OE_6$/PPA (115%) | Same | 55 |
| | c | 50/50 blend of 57a and 57b | Same | 25 |
| 58 | a | (2.7:1) iso $C_{10}H_{21}OE_6/P_2O_5$ | Antarox$^R$ BL 330 | 30 |
| | b | Same as 49b | Same | >130 |
| | c | 50/50 blend of 57a and 57b | Same | 15 |
| 59 | a | Same as 58a | Antarox$^R$ BL 225 | 35 |
| | b | Same as 58b | Same | >100 |
| | c | Same as 58c | Same | 15 |
| 60 | a | (2.7:1) n $C_6H_{13}OE_{3.5}/P_2O_5$ | Antarox$^R$ BL 330 | 40 |
| | b | (1:1) $C_6H_4OE_{10}$/PPA (115%) | Same | >100 |
| | c | 50/50 blend of 60a and 60b | Same | 15 |
| 61 | a | (2.7:1) iso $C_5H_{11}OE_4/P_2O_5$ | Same | >100 |
| | b | (1:1) iso $C_5H_{11}OE_4$/PPA (115%) | Same | >100 |
| | c | 50/50 blend of 61a and 61b | Same | 0 |

NOTE:
Antarox$^R$ BL 225 and BL 240 are low foaming nonionic surfactants from GAF Corporation. These structures are terminated by a polypropyleneoxy moiety wherein the end group is OH.
Antarox$^R$ BL 330 and BL 344 are low foaming nonionic surfactants from GAF Corporation. Their structures are such that the end "OH" group is replaced by a "Cl" atom.

EXAMPLE NUMBER 62

This example illustrates the present invention employing other species of the second phosphate ester.

The procedure of Example 2 was repeated except that the second phosphate ester is replaced with a second phosphate ester which is based on 110% polyphosphoric acid as shown in Column 1 of Table IX. The second phosphate ester is derived by reacting one $P_2O_5$ - mole - equivalent of 110% polyphosphoric acid with 1 mole of the condensation product of four moles of ethylene oxide and one mole of iso-anyl alcohol.

EXAMPLE NUMBER 63

This example illustrates the present invention employing other species of the second phosphate ester.

The procedure of Example 2 was repeated except that the second phosphate ester is replaced with a second phosphate ester which is based on 118.8% polyphosphoric acid as shown in column 2 of Table IX. The second phosphate ester is derived by reacting one $P_2O_5$ - mole - equivalent of 118.8% polyphosphoric acid with 1 mole of the condensation product of four moles of ethylene oxide and one mole of iso-amyl alcohol.

TABLE IX

| COMPOSITION OF POLYPHOSPHORIC ACIDS | Col. 1 110%/PPA | | Col. 2 118.8% PPA | |
|---|---|---|---|---|
| | g/100g | moles/100g | g/100g | moles/100g |
| Orthophosphoric Acid, $H_3PO_4$, MW 98 | 20.5 | 0.209 | 1.46 | 0.0149 |
| Pyrophosphoric Acid, $H_4P_2O_7$, MW 178 | 46.2 | 0.259 | 2.81 | 0.0158 |
| Tripolyphosphoric Acid, $H_5P_3O_{10}$, MW 258 | 20.6 | 0.080 | 3.74 | 0.0145 |
| Tetrapolyphosphoric Acid, $H_6P_4O_{13}$, MW 338 | 8.8 | 0.026 | 4.43 | 0.0131 |
| Pentapolyphosphoric Acid, $H_7P_5O_{16}$, MW 418 | 3.4 | 0.008 | 4.52 | 0.0106 |
| Hexapolyphosphoric Acid, $H_8P_6O_{19}$, MW 498 | 0.5 | 0.0013 | 4.77 | 0.0096 |
| Heptapolyphosphoric Acid, $H_9P_7O_{22}$, MW 578 | | | 4.79 | 0.0083 |
| Octapolyphosphoric Acid, $H_{10}P_8O_{25}$, MW 658 | | | 4.93 | 0.0075 |
| Nonapolyphosphoric Acid, $H_{11}P_9O_{28}$, MW 738 | | | 4.67 | 0.0063 |
| Decapolyphosphoric Acid, $H_{12}P_{10}O_{30}$, MW 818 | | | 4.54 | 0.0056 |
| Undecapolyphosphoric Acid, $H_{13}P_{11}O_{33}$, MW 898 | | | 4.67 | 0.0052 |
| Dodecapolyphosphoric Acid, $H_{14}P_{12}O_{36}$, MW 978 | | | 4.63 | 0.0047 |
| Tridecapolyphosphoric Acid, $H_{15}P_{13}O_{39}$, MW 1058 | | | 4.38 | 0.0041 |
| Tetradecapolyphosphoric Acid, $H_{16}P_{14}O_{42}$, MW 1138 | | | 4.17 | 0.0037 |
| Higher Polyphosphoric Acid MW>1218 | | | 43.5 | <0.0357 |
| Total | 100 | 0.5833 | ca. 100 | <0.1596 |

PPA = Polyphosphoric Acid

Although the invention has been described in considerable detail with reference to certain preferred embodiments thereof, it will be understood that variations and modifications can be effected within the spirit and scope of the invention as described above and as defined in the appended claims.

What is claimed is:

1. A detergent composition consisting essentially of

I. a low-foaming, non-ionic surfactant and,

II. a synergistic hydrotrope mixture of;

A. a first phosphate ester which is the reaction product of:

(1) phosphorus pentoxide with (2) a compound of Formula I:

$$R + OCH_2 - CH_2 +_n OH \quad (I)$$

wherein R is alkyl, aryl, aralkyl or alkaryl and wherein n is 1 to 10, and the molar ratio of (1) to (2) is 1:2 to 1:4.5 and B. a second phosphate ester which is the reaction product of:

(1) 105–130% polyphosphoric acid with (2) a compound of Formula I and the molar ratio of (1) to (2) is 1:0.3 to 1:1.5 and wherein the weight ratio of A:B is 1:9 to 9:1, and III. a builder selected from the group consisting of alkali metal hydroxides, carbonates, bicarbonates, phosphates, silicates, sulfates, and chlorides.

2. The detergent composition of claim 1 wherein the weight ratio of surfactant (I) to synergistic hydrotrope mixture (II) is 1:20 to 5:1.

3. The detergent composition of claim 1 wherein the weight ratio of surfactant (I) to synergistic hydrotrope mixture (II) is 1:10 to 2:1.

4. The detergent composition of claim 1 wherein the weight ratio of surfactant (I) to builder (III) is 1:5 to 1:100.

5. A detergent composition of claim 1 wherein the second phosphate ester is a mixture of two different phosphate esters.

6. A composition according to claim 1 wherein A is the reaction product of phosphorous pentoxide with a compound of the formula $C_6H_5(OCH_2CH_2)_6OH$, and B is the reaction product of 115% polyphosphoric acid with a compound of the formula iso $C_5H_{11}(OCH_2CH_2)_4OH$.

7. A composition according to claim 1 wherein A is the reaction product of phosphorous pentoxide with a compound of the formula $C_6H_5(OCH_2CH_2)_6OH$ and B is the reaction product of 115% polyphosphoric acid with a compound of the formula $C_4H_9(OCH_2CH_2)_7OH$.

8. A detergent composition consisting essentially of

I. a low-foaming non-ionic surfactant and,

II. a synergistic hydrotrope mixture of:

A. a first phosphate ester which is the reaction product of:

(1) phosphorus pentoxide with (2) a compound of Formula I:

$$R - OCH_2 - CH_2 -_n OH \quad (I)$$

wherein R is an alkyl group with 4 to 10 carbon atoms, a phenyl group or an alkyl-phenylene group whose alkyl portion has 1 to 4 carbon atoms and wherein n is 1 to 10, and the molar ratio of (1) to (2) is 1:2 to 1:4 and B. a second phosphate ester which is the reaction product of (1) 110–120% polyphosphoric acid with (2) a compound of Formula I wherein the molar ratio of (1) to (2) is 1:0.75 to 1:1.25, and wherein the weight ratio of A:B is 1:4 to 4:1, and III. a builder selected from the group consisting of alkali metal hydroxides, carbonates, bicarbonates, phosphates, silicates, sulfates and chlorides.

* * * * *